United States Patent [19]

Hendren

[11] Patent Number: 5,076,887

[45] Date of Patent: Dec. 31, 1991

[54] PRESSBOARD AND PROCESS FOR ITS PRODUCTION

[75] Inventor: Gary L. Hendren, Richmond, Va.

[73] Assignee: E. I. Du Pont de Nemours and Company, Wilmington, Del.

[21] Appl. No.: 586,857

[22] Filed: Sep. 25, 1990

[51] Int. Cl.[5] ..... D21H 13/26

[52] U.S. Cl. ..... 162/123; 162/146; 162/157.3; 162/206

[58] Field of Search ..... 162/123, 146, 157.3, 162/206

[56] References Cited

U.S. PATENT DOCUMENTS 4,752,355 6/1988 Provost ..... 162/157.3

4,888,091 12/1989 Nollen ..... 162/157.3

*Primary Examiner*—Peter Chin

[57] ABSTRACT

High temperature resistant pressboard having a density of 0.70 to 0.90 g/cc, a calculated void volume of 31 to 49, percent by volume of said pressboard and a smoothness of 80 to 250 microinches MD range and 90 to 260 microinches is disclosed. The pressboard is prepared by wet laying an aqueous dispersion of polyaramid fibrids and floc to form a waterleaf building up layers to form a wet lap which is dried and then pressed at 270° C. to 520° C. rising a press with a predetermined minimum opening to form the desired smooth low density pressboard.

8 Claims, No Drawings

PRESSBOARD AND PROCESS FOR ITS PRODUCTION

BACKGROUND OF THE INVENTION

1. Field of the Invention

The present invention relates to the production of smooth surfaced pressboard from polyaramid fibers.

2. Prior Art

U.S. 4,752,355 discloses a polyaramid pressboard and its production. The "Standard Pressboard" precursor referred to in this reference, though having relatively low density, has a very rough surface. The compression resistant pressboard product prepared by this reference is very dense.

SUMMARY OF THE INVENTION

The present invention relates to forming pressboard from polyaramid fiber by pressing to a predetermined controlled thickness. Surprisingly, because of the predetermined amount of compression a relatively smooth pressboard is obtained with relatively low density.

DETAILED DESCRIPTION OF THE INVENTION

The present invention relates to polyaramid pressboard intended for use as a thin thermal barrier in automobiles. Present low density polyaramid pressboards have a rough surface caused by the screen pattern from the press used in their manufacture. This rough surface is undesirable when the pressboards are used in automobiles because such a surface can lead to increased pickup of dirt, dust, grease and moisture. Thus, it is desirable to have a smooth, impervious surface to prevent this pickup.

The present invention uses a platen operated at above the glass transition temperature (Tg) of the polyaramid being used to form the pressboard similar to the technique used to form dense polyaramid pressboards; but uses a stop mechanism so that a pressboard having a relatively low density of 0.70 to 0.95 g/cc is produced. The high temperature of the platen serves to fuse the polyaramid fibers near the surface of the pressboard making it impervious to contaminants while still forming a pressboard of low enough density to be useful as a thermal barrier and be economically attractive for this use.

The pressboard of the present invention comprises 20 to 95% by weight polyaramid fibrids and 80 to 5% by weight high temperature resistant floc, said pressboard having a calculated void volume of 31 to 49% by volume of the pressboard, and a thickness of 0.8 to 5.0 mm.

Preferably the pressboard comprises 50 to 70% by weight polyaramid fibrids and 30 to 50% by weight high temperature resistant floc. Preferably the high temperature resistant floc consists of a polyaramid. Preferably the polyaramid fibrids and high temperature resistant floc consist essentially of poly(p-phenylene isophthalamide)(MPD-I). The pressboard preferably comprises polyaramid fibrids and floc and has a thickness of 0.8 to 5.0 mm, a density of 0.70 to 0.95 g/cc and most preferably 0.70 to 0.80 g/cc.

The pressboard is prepared using an aqueous slurry of 0.1 to 2.0% by weight total solids comprising 20 to 95% by weight polyaramid fibrids and 80 to 5% by weight high temperature resistant floc having a length of 2 to 12 mm, said polyaramid fibrids and high temperature floc having a melting point of higher than 320° C. The slurry is formed into a waterleaf having a water content of 50 to 95% by weight. The waterleaf is combined into multiple layers to form a wet lap, the wet lap is pressed at 100° C. to 200° C. under a pressure of 10 to 60 kg/cm$^2$ to form low density pressboard having a calculated void volume of 30 to 60% by volume of the pressboard. The low density pressboard is dried, ultimately at 270° C. to 320° C., until no further moisture is evolved, and finally pressed at 8 to 350 kg/cm$^2$ at 270° C. to 320° C. with a mechanical stop to prevent excessive densification. Preferably the pressing temperature is 275°-300° C. Most preferably, the final pressing is at 275° to 285° C. and the pressure is 15 to 70 kg/cm$^2$. Preferably the pressboard is cooled under restraint to prevent warping.

By "polyaramid" is meant a thermoplastic polymer containing repeating units of the formula -(-NH--Ar--NH--CO--Ar'--CO-)- wherein Ar and Ar' aromatic groups containing 6 to 14 carbon atoms. Preferably -Ar- and -Ar'- are phenylene, biphenylene, or naphthalene groups. Especially preferred is the case where both -Ar- and -Ar'- are phenylene groups.

By "polyaramid fibrids" is meant small, nongranular, nonrigid fibrous or film-like particles of a polyaramid having a melting point higher than 320° C. Two of their three dimensions are of the order of microns. Their smallness and suppleness allows them to be deposited in physically entwined configurations such as are commonly found in papers made from wood pulp. Fibrids can be prepared by precipitating a solution of the polyaramid into a coagulant such as described in U.S. Patent No. 3,018,091.

By "high temperature resistant floc" is meant short fibers, typically having a length of 2 to 12 mm and a linear density of 1-10 decitex, made of a material having a melting point higher than 320° C. such as polyaramids, aromatic polyamide-imides, aromatic polyimides, polybenzimidazoles, polybenzoxides, and the like, or inorganic materials such as glass, ceramic materials, aluminum, and the like. Other high temperature materials such as mica may also be present in relatively fine subdivided form.

By "polyaramid floc" is meant short fibers cut from fibers by a process such as those described in U.S. Pat. Nos. 3,063,966; 3,133,138; 3,767,756; and 3,869,430.

The polyaramid pressboard may be prepared by feeding an aqueous slurry of polyaramid fibrids and polyaramid floc to a cylinder paper making machine whereby water is removed and multiple layers of fibrous material having a water content of 50 to 95% by weight of the wet sheet are built up to a wet lap of the desired thickness. The wet lap is cut from the cylinder, laid flat and pressed at 100° to 200° C. under a pressure of 10 to 60 kg/cm$^2$. The resulting pressboard has a calculated void volume of 35 to 50% by volume of the pressboard.

In accordance with the present invention, the pressboard prepared, as described above, is further dried, ultimately at a temperature of 270° to 320° C., until substantially no further moisture is evolved; and it is then pressed at a temperature of 270° to 320° C. and a pressure of 8 to 350 kg/cm$^2$ wherein the pressure applying means is limited mechanically in the amount of compression that can be applied to the pressboard, preferably followed by cooling the pressboard under restraint. A pressboard having the desired properties of a density of 0.70 to 0.95 g/cc, a calculated void volume of 31 to 41% by volume of the pressboard, and a surface smoothness of less than 300 micro inches ($7.33\times10^{-6}$m) can be obtained in both the machine and cross directions. Machine direction (MD) and cross direction (CD) of the pressboard is based on the original sheet orientation to the paper machine.

The drying is preferably accomplished by step-wise increases in temperature. Moisture evolution is facilitated by application and release of light pressure. In general the pressing is preferably at 275° to 300° C. at 15 to 70 kg/cm$^2$ for at least 5 minutes, but thick products may require longer times. The final temperature, in the drying steps, should be at or above the glass transition temperature (Tg) of the polyaramid fibrids which, in the case of the preferred poly(m-phenylene isophthalamide), is about 275° C.

The pressboard of this invention is useful in forming insulation such as for use in automobiles in particularly for the firewall separating the engine compartment from the passenger compartment. Products of this invention have a calculated void volume of 31 to 41% by volume of the pressboard and preferably a calculated void volume of 42 to 49% by volume and a preferred range of surface smoothness of less than 300 micro inches ($7.33\times10^{-6}$m).

TESTS

Density: Dry pressboard is cut into a rectangular sample measuring at least 10 cm by 10 cm making sure that the corners are cut square so that the upper and lower faces of the sample are of the same area and that the dimensions can be measured accurately. The length and width of the sample are measured to an accuracy of at least 0.25 cm. The thickness of the sample of pressboard is measured in at least ten places substantially equally apart around all sides of the pressboard, away from the edges, using a micrometer caliper which contacts the sample with surfaces having a diameter of about 0.16 cm at a pressure of about 0.1 kg/cm$^2$, to an accuracy of at least 0 00025 cm, averaging the ten thickness measurements. The sample of the pressboard is then weighed to the nearest 0.0001 g. The volume of the pressboard $V_b$ is calculated in cm$^3$ and the weight is divided by the volume to give the density in g/cm$^3$.

Calculated Void Volume: The void volume in cm$^3$, $V_v$, of a sample of the pressboard is determined from the relationship $$V_b = V_m + V_v \text{ or}$$

$$V_v = V_b - V_m \text{ where}$$

$V_b$ is the volume of the pressboard in cm$^3$ as determined above, $V_m$ is the total volume of all materials comprising the pressboard, and $V_v$ is the remaining volume in cm$^3$, which is taken as the void volume. $V_m$ is determined from the weights and densities of each of the materials of which the pressboard is made, calculated as follows:

$$V_m = \frac{W_f}{1.38\ \text{g/cm}^3} + \frac{W_i}{P_i}$$

where $W_f$ is the weight in g of the polyaramid fibrids in the pressboard sample, $W_i$ is the weight in g of the floc (including any other non-fibrid high temperature resistant material) in the pressboard sample, and Pi is the density of the material of which the floc is made (1.38 g/cm$^3$ for MpD-I and 1.44 g/cm$^3$ for poly(p-phenylene terephthalamide)). When there is more than one kind of floc (or other high temperature resistant material such as mica), Wi/Pi is calculated as follows:

$$\frac{W_i}{P_i} = \frac{W_1}{P_1} + \frac{W_2}{P_2} + \ldots \frac{W_n}{P_n}$$

where i = 1, 2, . . . , n. The calculated void volume, as a percentage volume, % $V_v$ is then calculated as follows:

$$\%\ V_v = \left(1 - \frac{V_m}{V_b}\right)\times 100 = \left(\frac{V_b - V_m}{V_b}\right)\times 100$$

In the case of a 100% MPD-I pressboard sample having a weight, in grams, of $W_b$ and a volume, in cm$^3$, of $V_b$, and since for this case $$V_m = \frac{W_b}{1.38\ \text{g/cm}^3}$$

the equation reduces to $$\%\ V_v = \left(1 - \frac{W_b}{V_b - 1.38\ \text{g/cm}^3}\right)\times 100$$

The calculated void volume is a measure of all of the voids, both isolated voids and interconnected voids, in a sample of pressboard.

PREFERRED EMBODIMENTS OF THE INVENTION

EXAMPLE 1

A. Preparation of "Standard Pressboard"

Filaments of poly(m-phenylene isophthalamide)(MPD-I) having an inherent viscosity of 1.5, as measured from a 0.5 wt % solution in concentrated sulfuric acid, were dry spun from a solution containing 19 wt % MPD-I, 70 wt % dimethylacetamide (DMAc), 9 wt % calcium chloride and 2 wt % water. On leaving the drying tower, the as-spun filaments were given a preliminary wash with water so that they contained about 60 wt % DMAc, 15 wt % calcium chloride and 100–150 wt % water, based on the weight of dry polymer. The filaments were washed and drawn 4× at 90° C. in a counter-current extraction-draw process in which the calcium chloride, determined as chloride content and DMAc content were reduced to about 0.1 wt % and 0.5 wt % respectively. The filaments were crystallized immediately after drawing by passing them over hot rolls at a temperature of about 340° C. The filaments so-produced had a linear density of 2.2 decitex (2.0 denier), a tenacity of about 3.7 dN/tex (4.2 g/denier), an initial modulus of 70 dN/tex (79 gpd) and an elongation of 34%. The filaments were cut to floc having a length of 3.4 mm (0.135 in).

Fibrids of MPD-I having an inherent viscosity of 1.5 as determined from a 0.5 wt % solution in concentrated sulfuric acid, were prepared substantially as described by Gross in U.S. Pat. No. 3,756,908, column 5, lines 34–54, stopping short of the refining step.

An aqueous slurry was prepared containing 1.0 wt % fibrids and floc having a solid composition containing 60 wt % of the above MPD-I fibrids and 40 wt % of the MPD-I floc. The slurry was held in an agitated vessel and then pumped to a double disc refiner (Beloit Jones Model 3000 20-inch Double Disc refiner, made by the Jones division of the Beloit Corporation, Dalton, Mass. 01226) equipped with refining discs containing narrow bass and channels with surface dams. The plates of the refiner were positioned with a gap of 0.5 mm (20 mils) between the rotor and stator plates. The rotor plates were operated at 900 rpm. After passing through the refiner, the slurry was passed through a second refiner operating under the same conditions. After the two passes through the refiners the fibrids in the slurry were well reduced in size and well opened into fibrid films, while the floc fibers were well distributed among the fibrids. The slurry made in this way was then diluted to approximately 0.1 wt % solids and fed to a conventional cylinder wet paper-making machine upon which a continuous sheet of wet paper was made and transferred to an endless felt, the moisture content being adjusted by suction and pressure to about 400% based on solids (80% by weight based on wet sheet). The weight of the solids in the wet paper was approximately 36 g/m$^2$. The continuous wet sheet was next delivered to a forming roll, where it was wound continuously on a cylindrical tube until it overlapped about 70 times. A longitudinal cut was then made in the layered paper and the entire thickness of wet lap (wet layered paper) was removed and placed between platens of a hot press; — the platens being maintained at 140° C. and having been covered with a wire screen to facilitate moisture removal. The press was loaded at contact pressure, and the pressure was raised to and maintained for one hour at 35 kg/cm$^2$ while the temperature was maintained at 140° C. The product, herein designated as "Standard Pressboard" was a low density polyaramid pressboard approximately 1.6 mm thick. It was found to have a density of 0.85 g/cm$^3$, a basis weight of 37 ounces per square yard (1.2 kg/m$^2$), a calculated void volume, and a % $V_v$ of 38% by volume pressboard.

B. One 25.5 cm×25.5 cm rectangular sheet of "Standard Pressboard" prepared as described in Part A above was predried at 150° C. The pressboard was then placed immediately in a hot press having platens oil heated to 280° C. and subjected to three 1 minutes cycles of contact pressure at 2 kg/cm$^2$ and 280° C. followed by release of pressure. A one-minute cycle wherein the platens were heated to 280° C. and the space between the platens was mechanically set at 1.4 mm followed. The pressboard was taken out hot and placed under contact pressure in a separate press, initially at room temperature and water cooled to absorb the heat of the pressboard. The product was a polyaramid pressboard approximately 1.4 mm thick. It was fond to have the density and smoothness reported in the Table below.

EXAMPLE 2

Example 1 was repeated except the "Standard Pressboard" Basis Weight was 36 ounces per square yard (1.22 kg/m$^2$) and the final press cycle was shortened to 30 secs. It was found to have the density and smoothness reported in the Table below.

EXAMPLE 3

Example 1 was repeated except the "Standard Pressboard" Basis Weight was 30.6 ounces per square yard (1.04 kg/m2). It was found to have the density and smoothness reported in the Table below.

EXAMPLE 4

Example 1 was repeated except the "Standard Pressboard" Basis Weight was 36.6 ounces per square yard (1.24 kg/m$^2$). It was found to have the density and smoothness reported in the Table below.

EXAMPLE 5

Example 1 was repeated except the "Standard Pressboard" Basis Weight was 36 ounces per square yard (1.22 kg/m$^2$). It was found to have the density and smoothness reported in the Table below.

EXAMPLE 6

Example 1 was repeated except the "Standard Pressboard" Basis Weight was 37.6 ounces per square yard (1.27 kg/m$^2$). It was found to have the density and smoothness reported in the Table below.

TABLE

| | | MD Range | | CD Range | |
|---|---|---|---|---|---|
| Example | Density g/cc | Micro-inches | (×10$^7$m) | Micro-inches | (×10$^7$m) |
| 1 | 0.85 | 150–190 | (38–48) | 130–188 | (33–46) |
| 2 | 0.73 | 200–240 | (51–61) | 170–240 | (43–61) |
| 3 | 0.79 | 150–210 | (38–53) | 200–250 | (51–60) |
| 4 | 0.90 | 90–140 | (23–36) | 130–170 | (33–43) |
| 5 | 0.88 | 120–180 | (30–46) | 100–130 | (25–33) |
| 6 | 0.91 | 140–170 | (36–43) | 130–170 | (33–43) |

I claim:

1. A pressboard having a density of 0.70 to 0.95 g/cc comprising 20 to 95 percent by weight polyaramid fibrids and 80 to 5 percent by weight high temperature resistant floc having a melting point of higher than 320° C., said pressboard having a calculated void volume of 31 to 49 percent by volume of the pressboard and a surface smoothness of 80 to 250 microinches (MD Range) and 90 to 260 microinches (CD Range).

2. A pressboard of claim 2 wherein the high temperature resistant floc is a polyaramid.

3. A pressboard of claim 2 wherein the aromatic polyaramid fibrids and floc consist essentially of poly(m-phenylene isophthalamide).

4. A pressboard of claim 3 wherein the pressboard comprises 50 to 70 percent by weight fibrids and 30 to 50 percent by weight floc.

5. A process for preparing a pressboard of claim 1 comprising the steps of forming an aqueous slurry having 0.1 to 2 percent by weight total solids comprising 20 to 95 percent by weight polyaramid fibrids and 80 to 5 percent by weight high temperature resistant floc having a length of 2 to 12 mm, said polyaramid fibrids and said high temperature resistant floc having a melting point higher than 320° C. into a water leaf having a water content of 50 to 95 percent by weight of the waterleaf, combining the waterleaf into multiple layers to form a wet lap, pressing the wet lap at 100° to 200° C. under a pressure of 10 to 60 kg/cm$^2$ to form a low density pressboard having a calculated void volume of 30 to 50 percent by volume of the pressboard, drying the pressboard ultimately at 270° to 320° C., until substantially no moisture is released and then pressed at 8 to 350 kg/cm$^2$ and 270° to 320° C. using a mechanical restraint on the pressing means so that the density of the pressboard is from 0.70 to 0.95 g/cc.

6. The process of claim 5 wherein the high temperature floc is a polyaramid.

7. The process of claim 6 wherein the pressboard comprises 50 to 70 percent by weight of poly(m-phenylene isophthalamide) fibrids and 30 to 50 percent by weight poly(m-phenylene isophthalamide) floc.

8. The process of claim 7 wherein the low density pressboard is dried ultimately at 275° C. to 300° C., and pressed at 275° C. to 285° C.

* * * * *